US007419300B2

(12) United States Patent
Pawloski et al.

(10) Patent No.: US 7,419,300 B2
(45) Date of Patent: Sep. 2, 2008

(54) POUCH HAVING FOLD-UP HANDLES

(75) Inventors: James C. Pawloski, Bay City, MI (US); Robert R. Turvey, Sanford, MI (US); Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 484 days.

(21) Appl. No.: 10/869,099

(22) Filed: Jun. 16, 2004

(65) Prior Publication Data

US 2005/0281487 A1 Dec. 22, 2005

(51) Int. Cl.
*B65D 33/06* (2006.01)

(52) U.S. Cl. ..... 383/14; 383/10; 383/61.2; 383/63

(58) Field of Classification Search ..... 383/14, 383/6, 7, 15, 10, 61.2, 65, 63
See application file for complete search history.

(56) References Cited

U.S. PATENT DOCUMENTS

| | | | | |
|---|---|---|---|---|
| 475,248 | A | 5/1892 | Pugsley | |
| 1,600,345 | A * | 9/1926 | Littman | 383/10 |
| 1,746,565 | A | 2/1930 | Sundback | |
| 1,959,318 | A | 5/1934 | Sundback | |
| 2,354,485 | A | 7/1944 | Slaughter | |
| 2,503,746 | A * | 4/1950 | Klehr | 190/119 |
| 2,555,844 | A * | 6/1951 | De Rouville | 383/6 |
| 2,625,318 | A * | 1/1953 | Ross | 383/14 |
| 2,916,197 | A | 12/1959 | Detrie et al. | |
| 2,978,769 | A | 4/1961 | Harrah | |
| 3,038,225 | A | 6/1962 | Ausnit | |
| 3,172,443 | A | 3/1965 | Ausnit | |
| 3,198,228 | A | 8/1965 | Naito et al. | |
| 3,219,084 | A | 11/1965 | Ausnit et al. | |
| 3,237,844 | A | 3/1966 | Hughes | |
| 3,265,789 | A | 8/1966 | Hofer | |
| 3,282,493 | A | 11/1966 | Kamins et al. | 229/54 |

(Continued)

FOREIGN PATENT DOCUMENTS

| | | |
|---|---|---|
| CA | 7 646 47 | 8/1967 |

(Continued)

OTHER PUBLICATIONS

Web page from www.zippak.com "One-Time Locking Zipper", date unknown.

(Continued)

*Primary Examiner*—Nathan J Newhouse
*Assistant Examiner*—Jack H Morgan, Jr.

(57) ABSTRACT

A reclosable pouch includes a closure assembly that comprises first and second closure profiles disposed on first and second side panels, respectively. A handle is provided that comprises discrete first and second handle sections. Each handle section has an opening in a central portion thereof. The first handle section is attached only to the first side panel at an area below the first closure profile and the second handle section is attached only to the second side panel at an area below the second closure profile. By providing the handle sections in such a manner, the first and second handle sections exert substantially more force on an internal side of the first and second closure profiles, respectively, than on an external side of the respective closure profiles.

34 Claims, 13 Drawing Sheets

U.S. PATENT DOCUMENTS

| | | | | |
|---|---|---|---|---|
| 3,311,144 | A | 3/1967 | Lindley | 150/3 |
| 3,338,284 | A | 8/1967 | Ausnit | |
| 3,338,285 | A | 8/1967 | Jaster | |
| 3,340,116 | A | 9/1967 | Naito | |
| 3,347,298 | A | 10/1967 | Ausnit et al. | |
| 3,372,442 | A | 3/1968 | Ishimatsu | |
| 3,402,749 | A | 9/1968 | Kinzler | |
| 3,410,327 | A | 11/1968 | Ausnit | |
| 3,416,199 | A | 12/1968 | Imamura | |
| 3,462,332 | A | 8/1969 | Goto | |
| 3,509,927 | A | 5/1970 | Hasty et al. | |
| 3,528,600 | A | 9/1970 | White | |
| 3,537,153 | A | 11/1970 | Ausnit | |
| 3,565,147 | A | 2/1971 | Ausnit | |
| 3,565,737 | A | 2/1971 | Lefevre et al. | |
| 3,567,110 | A | 3/1971 | Susuki et al. | 229/54 |
| RE27,174 | E | 9/1971 | Ausnit | |
| 3,608,439 | A | 9/1971 | Ausnit | |
| 3,715,420 | A | 2/1973 | Kiyono et al. | |
| 3,780,781 | A | 12/1973 | Uramoto | |
| 3,827,472 | A | 8/1974 | Uramoto | |
| 3,840,418 | A | 10/1974 | Sabee | |
| 3,841,816 | A | 10/1974 | Herz | |
| 3,877,352 | A | 4/1975 | Brieske | 93/35 |
| 3,937,395 | A | 2/1976 | Lawes | |
| 3,959,856 | A | 6/1976 | Ausnit | |
| 3,966,524 | A | 6/1976 | Lehmacher | |
| RE28,969 | E | 9/1976 | Naito | |
| 3,991,801 | A | 11/1976 | Ausnit | |
| 4,046,408 | A | 9/1977 | Ausnit | |
| 4,087,577 | A | 5/1978 | Hendrickson | |
| 4,139,664 | A | 2/1979 | Wenrick | |
| 4,240,604 | A | 12/1980 | Brach | |
| 4,263,079 | A | 4/1981 | Sutrina et al. | |
| 4,268,938 | A | 5/1981 | Walchli | |
| 4,279,677 | A | 7/1981 | Takahashi | |
| 4,285,376 | A | 8/1981 | Ausnit | |
| 4,306,924 | A | 12/1981 | Kamp | |
| 4,315,963 | A | 2/1982 | Havens | |
| 4,354,541 | A | 10/1982 | Tilman | |
| 4,363,345 | A | 12/1982 | Scheibner | |
| 4,372,014 | A | 2/1983 | Simpson | |
| 4,375,111 | A | 3/1983 | Hall | |
| 4,419,159 | A | 12/1983 | Herrington | |
| 4,428,788 | A | 1/1984 | Kamp | |
| 4,484,352 | A | 11/1984 | Katzin | |
| 4,515,647 | A | 5/1985 | Behr | |
| 4,522,678 | A | 6/1985 | Zieke | |
| 4,532,652 | A | 7/1985 | Herrington | |
| 4,555,282 | A | 11/1985 | Yano | |
| 4,561,108 | A | 12/1985 | Kamp | |
| 4,561,109 | A | 12/1985 | Herrington | |
| 4,562,027 | A | 12/1985 | Behr et al. | |
| 4,573,203 | A | 2/1986 | Peppiatt | 383/8 |
| 4,578,813 | A | 3/1986 | Ausnit | |
| 4,615,045 | A | 9/1986 | Siegel | |
| 4,618,383 | A | 10/1986 | Herrington | |
| 4,655,862 | A | 4/1987 | Christoff et al. | |
| 4,665,557 | A | 5/1987 | Kamp | |
| 4,672,723 | A | 6/1987 | Hugues et al. | |
| 4,673,383 | A | 6/1987 | Bentsen | |
| 4,676,851 | A | 6/1987 | Scheibner et al. | |
| 4,682,366 | A | 7/1987 | Ausnit et al. | |
| 4,683,015 | A | 7/1987 | Wagers | |
| 4,684,018 | A | 8/1987 | Jarund | |
| 4,698,118 | A | 10/1987 | Takahashi | |
| 4,701,358 | A | 10/1987 | Behr et al. | |
| 4,709,399 | A | 11/1987 | Sanders | |
| 4,710,968 | A | 12/1987 | Borchardt et al. | |
| 4,713,839 | A | 12/1987 | Peppiatt | |
| 4,715,728 | A | 12/1987 | Sfikas | 383/9 |
| 4,727,709 | A | 3/1988 | Zieke et al. | |
| 4,731,911 | A | 3/1988 | Gould | |
| 4,736,451 | A | 4/1988 | Ausnit | |
| 4,736,496 | A | 4/1988 | Fisher et al. | |
| 4,741,789 | A | 5/1988 | Zieke et al. | |
| 4,755,248 | A | 7/1988 | Geiger et al. | |
| 4,764,977 | A | 8/1988 | Wagers | |
| 4,765,036 | A | 8/1988 | Iguchi et al. | |
| 4,778,282 | A | 10/1988 | Borchardt et al. | |
| 4,787,880 | A | 11/1988 | Ausnit | |
| 4,791,710 | A | 12/1988 | Nocek et al. | |
| 4,792,240 | A | 12/1988 | Ausnit | |
| 4,792,983 | A | 12/1988 | Allegre | |
| 4,796,300 | A | 1/1989 | Branson | |
| 4,812,056 | A | 3/1989 | Zieke | |
| 4,812,192 | A | 3/1989 | Woods et al. | |
| 4,817,188 | A | 3/1989 | Van Erden | |
| 4,822,539 | A | 4/1989 | Tilman et al. | |
| 4,829,641 | A | 5/1989 | Williams | |
| 4,832,768 | A | 5/1989 | Takahashi | |
| 4,834,554 | A | 5/1989 | Stetler, Jr. et al. | |
| 4,846,586 | A | 7/1989 | Bruno | |
| 4,854,733 | A | 8/1989 | Schwinn | 383/29 |
| 4,854,917 | A | 8/1989 | Mizukoshi | |
| 4,859,082 | A | 8/1989 | Llorens et al. | |
| 4,859,259 | A | 8/1989 | Scheibner | |
| 4,869,725 | A | 9/1989 | Schneider et al. | |
| 4,872,766 | A | 10/1989 | Dancy | |
| 4,877,336 | A | 10/1989 | Peppiatt | 383/8 |
| 4,883,329 | A | 11/1989 | Flannery et al. | |
| 4,898,492 | A | 2/1990 | Janowski | |
| 4,906,310 | A | 3/1990 | Broderick et al. | |
| 4,907,321 | A | 3/1990 | Williams | |
| 4,929,487 | A | 5/1990 | Tilman et al. | |
| 4,964,739 | A | 10/1990 | Branson et al. | |
| 4,971,453 | A | 11/1990 | Rantanen | 383/20 |
| 5,009,828 | A | 4/1991 | McCree | |
| 5,012,561 | A | 5/1991 | Porchia et al. | |
| 5,017,021 | A | 5/1991 | Simonsen et al. | |
| 5,022,530 | A | 6/1991 | Zieke | |
| 5,023,122 | A | 6/1991 | Boeckmann et al. | |
| 5,033,868 | A | 7/1991 | Peppiatt | 383/29 |
| 5,049,223 | A | 9/1991 | Dais et al. | |
| 5,053,091 | A | 10/1991 | Giljam et al. | |
| 5,056,933 | A | 10/1991 | Kamp | |
| 5,067,822 | A | 11/1991 | Wirth et al. | |
| 5,070,584 | A | 12/1991 | Dais et al. | |
| 5,092,684 | A | 3/1992 | Weeks | |
| 5,108,195 | A * | 4/1992 | Perron | 383/10 |
| 5,112,138 | A | 5/1992 | Peppiatt | 383/29 |
| 5,121,995 | A | 6/1992 | Newman et al. | 383/29 |
| 5,138,750 | A | 8/1992 | Gundlach et al. | |
| 5,140,727 | A | 8/1992 | Dais et al. | |
| 5,141,577 | A | 8/1992 | Porchia et al. | |
| 5,145,258 | A | 9/1992 | Schneck et al. | 383/14 |
| 5,154,086 | A | 10/1992 | Porchia et al. | |
| 5,167,454 | A | 12/1992 | Woods et al. | |
| 5,186,543 | A | 2/1993 | Cochran | |
| 5,192,135 | A | 3/1993 | Woods et al. | |
| 5,198,055 | A | 3/1993 | Wirth et al. | |
| 5,209,574 | A | 5/1993 | Tilman | |
| 5,211,481 | A | 5/1993 | Tilman | |
| 5,221,143 | A | 6/1993 | Peppiatt | |
| 5,235,731 | A | 8/1993 | Anzai et al. | |
| 5,238,306 | A | 8/1993 | Heintz et al. | |
| 5,248,201 | A | 9/1993 | Kettner et al. | |
| 5,252,281 | A | 10/1993 | Kettner et al. | |
| 5,259,904 | A | 11/1993 | Ausnit | |
| 5,307,552 | A | 5/1994 | Dais et al. | |
| 5,326,176 | A | 7/1994 | Domke | |
| 5,356,222 | A | 10/1994 | Kettner et al. | |
| 5,358,334 | A | 10/1994 | Simonsen | |
| 5,361,905 | A | 11/1994 | McQueeny et al. | |

5,366,294 A 11/1994 Wirth et al.
5,368,394 A 11/1994 Scott et al.
5,369,847 A 12/1994 Naya et al.
5,382,094 A 1/1995 Ausnit
5,384,942 A 1/1995 Siegel
5,388,910 A 2/1995 Koyanagi
5,397,182 A 3/1995 Gaible et al.
5,403,094 A 4/1995 Tomic
5,405,561 A 4/1995 Dais et al.
5,415,904 A 5/1995 Takubo et al.
5,425,456 A 6/1995 Erickson
5,462,360 A 10/1995 Tilman et al.
5,472,082 A 12/1995 Thiele
5,478,228 A 12/1995 Dais et al.
5,492,705 A 2/1996 Porchia et al.
5,509,734 A 4/1996 Ausnit
5,511,884 A 4/1996 Bruno et al.
5,525,363 A 6/1996 Herber et al.
5,527,112 A 6/1996 Dais et al.
5,540,366 A 7/1996 Coomber
5,540,500 A 7/1996 Tanaka
5,558,439 A 9/1996 Tilman
5,564,834 A 10/1996 Porchia et al.
5,575,747 A 11/1996 Dais et al.
5,577,305 A 11/1996 Johnson
5,618,111 A 4/1997 Porchia et al.
5,636,783 A 6/1997 Preston
5,647,100 A 7/1997 Porchia et al.
5,655,273 A 8/1997 Tomic et al.
5,660,479 A 8/1997 May et al.
5,664,299 A 9/1997 Porchia et al.
5,669,715 A 9/1997 Dobreski et al.
5,672,009 A 9/1997 Malin
5,686,126 A 11/1997 Noel et al.
5,689,866 A 11/1997 Kasai et al.
5,709,478 A 1/1998 Chen
5,709,479 A 1/1998 Bell ..... 383/209
5,713,669 A 2/1998 Thomas et al.
5,718,024 A 2/1998 Robbins
5,722,128 A 3/1998 Toney et al.
5,729,876 A 3/1998 Johnson
5,749,658 A 5/1998 Kettner
5,769,772 A 6/1998 Wiley
5,774,954 A 7/1998 Ramsey et al.
5,774,955 A 7/1998 Borchardt et al.
5,775,812 A 7/1998 St. Phillips et al.
5,782,562 A 7/1998 Anspacher ..... 383/15
5,783,012 A 7/1998 Porchia et al.
5,788,378 A 8/1998 Thomas
5,791,783 A 8/1998 Porchia et al.
5,794,315 A 8/1998 Crabtree et al.
5,804,265 A 9/1998 Saad et al.
5,809,621 A 9/1998 McCree et al.
5,817,380 A 10/1998 Tanaka
5,827,163 A 10/1998 Kettner
5,832,145 A 11/1998 Dais et al.
5,832,570 A 11/1998 Thorpe et al.
5,832,699 A 11/1998 Zobel
5,836,056 A 11/1998 Porchia et al.
5,839,582 A 11/1998 Strong et al.
5,839,831 A 11/1998 Mazzocchi
D406,685 S 3/1999 McGinnis
5,878,468 A 3/1999 Tomic et al.
5,882,120 A 3/1999 Bell ..... 383/209
5,894,707 A 4/1999 May
5,902,046 A 5/1999 Shibata
5,911,508 A 6/1999 Dobreski et al.
5,927,855 A 7/1999 Tomic et al.
5,930,877 A 8/1999 Thorpe et al.
5,933,927 A 8/1999 Miller et al.
5,950,285 A 9/1999 Porchia et al.
5,953,796 A 9/1999 McMahon et al.
5,955,160 A 9/1999 Tanaka et al.
5,962,040 A 10/1999 Dais et al.
5,964,532 A 10/1999 St. Phillips et al.
5,988,880 A 11/1999 Tomic
6,004,032 A 12/1999 Kapperman et al.
6,004,034 A 12/1999 Salam
6,009,603 A 1/2000 Gallagher
6,010,244 A 1/2000 Dobreski et al.
6,014,795 A 1/2000 McMahon et al.
6,020,013 A 2/2000 Kozma
6,021,557 A 2/2000 Dais et al.
6,030,122 A 2/2000 Ramsey et al.
6,032,437 A 3/2000 Bois
6,053,635 A 4/2000 Anderson et al. ..... 383/10
6,065,872 A 5/2000 Johnson
6,071,011 A 6/2000 Thomas et al.
6,074,096 A 6/2000 Tilman
6,077,208 A 6/2000 Larkin et al.
6,080,252 A 6/2000 Plourde
6,085,906 A 7/2000 Lambert
6,092,931 A 7/2000 Tilman
6,110,586 A 8/2000 Johnson
6,112,374 A 9/2000 Van Erden
6,135,636 A 10/2000 Randall
6,138,329 A 10/2000 Johnson
6,148,588 A 11/2000 Thomas et al.
6,149,302 A 11/2000 Taheri
6,152,600 A 11/2000 Tomic
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 * 1/2001 Chen ..... 383/3
6,185,796 B1 2/2001 Ausnit
6,187,396 B1 2/2001 Möller
6,212,061 B1 4/2001 Irwin et al.
6,217,215 B1 4/2001 Tomic
6,217,216 B1 4/2001 Taheri
6,221,484 B1 4/2001 Leiter
6,228,485 B1 5/2001 Leiter
6,231,236 B1 5/2001 Tilman
6,257,763 B1 7/2001 Stolmeier et al.
6,270,257 B1 8/2001 Yeager
6,273,609 B1 8/2001 Johnson
6,279,298 B1 8/2001 Thomas et al.
6,286,681 B1 9/2001 Wilfong, Jr. et al.
6,286,999 B1 9/2001 Cappel et al.
6,299,353 B1 10/2001 Piechocki et al.
6,299,720 B1 10/2001 Van Erden
6,318,894 B1 11/2001 Derenthal
6,321,423 B1 11/2001 Johnson
6,341,688 B1 1/2002 Graham
6,345,911 B1 2/2002 Young et al. ..... 383/6
6,350,058 B1 2/2002 Linton
6,360,513 B1 * 3/2002 Strand et al. ..... 53/412
6,361,209 B1 3/2002 LaRue et al.
6,364,915 B1 4/2002 Chapman-Irwin et al.
6,412,254 B1 7/2002 Tilman et al.
6,442,804 B2 9/2002 Turvey et al.
6,461,042 B1 10/2002 Tomic et al.
6,461,043 B1 10/2002 Healy et al.
6,481,183 B1 11/2002 Schmidt ..... 53/412
6,481,890 B1 11/2002 VandenHeuvel
6,487,758 B2 12/2002 Shaffer et al.
6,491,433 B2 12/2002 Shabram, Jr. et al.
6,533,456 B1 3/2003 Buchman
6,539,594 B1 4/2003 Kasai et al.
6,582,122 B2 6/2003 Shimizu
6,592,260 B1 7/2003 Randall et al.
6,594,868 B1 7/2003 Savicki
6,594,872 B2 7/2003 Cisek
6,604,634 B2 8/2003 Su
6,637,939 B2 10/2003 Huffer
6,686,005 B2 2/2004 White et al.

| | | | | |
|---|---|---|---|---|
| 6,691,383 | B2 | 2/2004 | Linton | |
| 6,692,147 | B2 | 2/2004 | Nelson | |
| 6,712,509 | B2 | 3/2004 | Cappel | |
| 6,713,152 | B2 | 3/2004 | Chen et al. | |
| 6,764,478 | B2 | 7/2004 | Ashton et al. | |
| 6,805,485 | B2 | 10/2004 | Hogan et al. | |
| 6,826,808 | B2 | 12/2004 | Kutschka | |
| 6,860,952 | B2 | 3/2005 | Pawloski | |
| 6,874,935 | B2 | 4/2005 | Edelman et al. | |
| 6,901,637 | B2 | 6/2005 | Machacek | |
| 6,915,546 | B2 | 7/2005 | Kasai | |
| 6,955,465 | B2 | 10/2005 | Machacek et al. | |
| 6,957,914 | B2 | 10/2005 | Arends et al. | |
| 6,962,439 | B2 | 11/2005 | Taheri | |
| 7,097,358 | B2 | 8/2006 | Keith et al. | |
| 7,144,159 | B2 | 12/2006 | Piotrowski et al. | |
| 7,165,886 | B2 | 1/2007 | Linton et al. | |
| 2001/0043763 | A1 | 11/2001 | Saad et al. | |
| 2002/0090151 | A1 | 7/2002 | Skeens et al. | |
| 2002/0114540 | A1 | 8/2002 | Shimizu | |
| 2002/0153273 | A1 | 10/2002 | Mallik et al. | |
| 2002/0173414 | A1 | 11/2002 | Leighton | |
| 2003/0033694 | A1 | 2/2003 | Cisek | |
| 2003/0066267 | A1 | 4/2003 | Nelson | |
| 2003/0077008 | A1 | 4/2003 | Plourde et al. | |
| 2003/0077243 | A1 | 4/2003 | Fitzhugh et al. | |
| 2003/0099412 | A1* | 5/2003 | Schneider et al. | 383/5 |
| 2003/0167607 | A1 | 9/2003 | Linton | |
| 2003/0169947 | A1 | 9/2003 | Taheri | |
| 2003/0169948 | A1 | 9/2003 | Fenzl et al. | |
| 2003/0177619 | A1 | 9/2003 | Cisek | |
| 2003/0210836 | A1 | 11/2003 | Strand | |
| 2003/0219174 | A1 | 11/2003 | Piechocki | |
| 2003/0223654 | A1 | 12/2003 | Gerrits | |
| 2003/0223657 | A1 | 12/2003 | Belias et al. | |
| 2003/0236159 | A1* | 12/2003 | Worthy, Jr. | 493/394 |
| 2004/0001650 | A1 | 1/2004 | Piechocki et al. | |
| 2004/0045138 | A1 | 3/2004 | Kasai | |
| 2004/0047521 | A1 | 3/2004 | Berich et al. | |
| 2004/0078940 | A1 | 4/2004 | Ishizaki | |
| 2004/0091179 | A1 | 5/2004 | Anderson | |
| 2004/0146223 | A1 | 7/2004 | Marquet et al. | |
| 2004/0161167 | A1* | 8/2004 | Ausnit et al. | 383/5 |
| 2005/0063616 | A1 | 3/2005 | Chang | |
| 2005/0135712 | A1 | 6/2005 | Barbier et al. | |
| 2005/0185863 | A1 | 8/2005 | Carrillo | |
| 2005/0235468 | A1 | 10/2005 | Borchardt et al. | |
| 2005/0281487 | A1 | 12/2005 | Pawloski et al. | |
| 2006/0182369 | A1* | 8/2006 | Schneider et al. | 383/10 |
| 2006/0188177 | A1 | 8/2006 | Dyer et al. | |

FOREIGN PATENT DOCUMENTS

| | | | | |
|---|---|---|---|---|
| DE | 831 985 | | 2/1952 | 3/3 |
| DE | 1 998 062 | | 12/1968 | |
| DE | 1 511 925 | | 10/1969 | |
| DE | 2 036 432 | | 2/1971 | |
| DE | 21 42 623 | | 3/1973 | |
| DE | 3 032 889 | | 12/1981 | |
| DE | 31 44 702 | | 5/1983 | |
| DE | 3144702 | A1 * | 5/1983 | |
| DE | 202 11 038 | | 10/2002 | |
| EP | 0 025 656 | | 3/1981 | |
| EP | 0 089 680 | | 9/1983 | |
| EP | 0 114 373 | | 8/1984 | |
| EP | 0 155 612 | | 9/1985 | |
| EP | 0174159 | | 3/1986 | |
| EP | 0 220 476 | | 5/1987 | |
| EP | 0 241 334 | | 10/1987 | |
| EP | 0 398 731 | | 11/1990 | |
| EP | 0 427 010 | | 5/1991 | |
| EP | 0 543 737 | | 5/1993 | |
| EP | 1 038 774 | | 9/2000 | 9/20 |
| EP | 1 329 387 | | 7/2003 | |
| FR | 1 493 748 | | 9/1967 | |
| FR | 2 620 377 | | 3/1989 | |
| FR | 2854833 | | 11/2004 | |
| GB | 998967 | | 7/1965 | |
| GB | 1 092 452 | | 11/1967 | |
| GB | 1 156 170 | | 6/1969 | |
| GB | 1 326 945 | | 8/1973 | |
| GB | 2 008 538 | | 6/1979 | |
| GB | 2 116 144 | | 9/1983 | |
| GB | 2 117 351 | | 10/1983 | 33/24 |
| GB | 2 163 724 | | 3/1986 | |
| GB | 2 315 730 | | 2/1998 | |
| JP | 3 212 355 | | 9/1991 | |
| JP | 04 057 768 | | 2/1992 | |
| JP | 699 991 | | 4/1994 | |
| JP | 6 227 551 | | 8/1994 | |
| JP | 09-030538 | | 2/1997 | |
| JP | 9-328148 | | 12/1997 | |
| JP | 10072043 | | 3/1998 | |
| WO | WO 88/04634 | | 6/1988 | |
| WO | WO 02/34634 | | 5/2002 | |
| WO | WO 03/082693 | | 10/2003 | |

OTHER PUBLICATIONS

Web page from www.zippak.com "At-140 Zipper", date unknown.
Web page from www.ambag.com "Double Track Seal Top Bags", date unknown.
Web pages from www.ambag.com "Ambag Corporation Custom Plain Bag Guidelines"(7 pages), date unknown.
Web pages from www.plastic-bags.net "Plastic Bags" (5 pages), date unknown.
Photo-micrograph of "Fresh Pack Zipper" from Chantler Packaging (see http://www.chantlerpackaging.com), date unknown.
Web pages of "Ziplock Bag," by Rean Tai Plastic Co., Ltd at http://www.reantai.ttnet.net, (4 pages), date unknown.
Photographs of "Zipper Bag" from Thai Griptech Co., Ltd, of Thailand (3 pages), date unknown.
Photo-micrograph of "Zipper Bag" from Thai Griptech Co., Ltd. of Thailand, date unknown.
Photographs of "Ziploc Heavy Duty Big Bags" from S. C. Johnson & Sons, Inc., Large 21/4 Gallon Size (8.52 L), (4 pages), date unknown.
Photographs of "Vegetables & Fruits Fresh Pack" from Slim Kitchen, 280mmX270mm, (3 pages), date unknown.
Photographs of "Breast Milk Storage Bags" from Lansinoh, (4 pages), date unknown.
Web pages of "Breast Milk Storage Bags" by Lansinoh at http://store.babycenter.com/product/feeding/breastfeeding/pump accessories/3961, (2 pages), date unknown.
Photographs of box for "Breast Milk Storage Bags" by Lansinoh, (2 pages), date unknown.
Photographs of double zipper bag, name and origin unknown, (4 pages), date unknown.
Web pages of "4-Mil Double-Track Zip Poly Bags" advertised by Realemall.com at http://office-supply.realemall.com/B-O-X-Packaging/4Mil-DoubleTrack-Zip-Poly-Bags.asp, 5 pages, date unknown.
Web pages of "4-Mil Double-Track Zip Poly Bags" sold by Office Depot, 12"x15", Box Of 500, at http://www.officedepot.com/ddSKU.do?level=SK&id=499978, 2 pages, date unknown.
Web article "MS-1000 Offers Maximum Versatility" May 20, 2002 at http://www.packexpo.com/ve/34472/news/3070.html, 2 pages, date unknown.
Web pages of "Drawstring Bags" advertised manufactured by Co-Ordinated Packaging, Inc. at http://www.co-ordinatedpackaging.com/specimen_bags.htm, 2 pages, date unknown.

* cited by examiner

POUCH HAVING FOLD-UP HANDLES

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to reclosable pouches having handles, and more particularly, to a thermoplastic pouch having handles attached below a closure assembly of the pouch.

2. Description of the Background of the Invention

A thermoplastic pouch for the storage of items typically includes a closure assembly disposed at or adjacent a mouth of the pouch. In some instances, handles may be provided adjacent the mouth of the pouch to assist a user in transporting the pouch.

Peppiatt U.S. Pat. No. 4,877,336 discloses a bag comprising inner and outer webs of thermoplastic material. The outer web includes front and rear panels that are joined together by a loop-shaped handle portion at a top portion of the bag and a seam at the bottom of the bag. The handle portion has a width narrower than the width of the front and rear panels. The inner web includes top and bottom panels that are connected by a gusset at the top portion of the bag and a seam at the bottom of the bag. A perforated line is provided on the gusset that a user must tear open to gain access to the interior of the bag. Closure means are also disposed over the perforated line on the gusset for resealing of the bag.

Peppiatt U.S. Pat. No. 5,033,868 discloses a bag having front and rear panels. A mating closure structure is provided on a top end of the front and rear panels for opening and closing the bag. A loop handle is attached to the top end of the bag. The loop handle includes two flanges that are attached to respective front and rear panels adjacent the closure structure. Oval-shaped openings are disposed in the loop handle for permitting the user to grasp the handle with his hand. The loop handle also includes spaced parallel lines of perforations at a top portion of the handle to create a tear away handle portion. When the tear away handle portion is separated from the balance of the handle, two portions are formed that may be folded to either side of the bag to allow the user access to the closure structure.

Peppiatt U.S. Pat. No. 5,112,138 discloses a unitary outer piece of flexible plastic that includes rectangular front and rear panels with a gusset connecting the two panels at a top portion of the bag. A unitary inner piece of flexible plastic is also provided that includes rectangular front and rear panels with a gusset providing a connection at the top portion of the bag. A loop-shaped handle is disposed over the top portion of the bag, wherein edge portions of the web are attached to the outer front and rear panels. The handle is of a sufficient size to allow the loop-shaped handle to be slipped over a user's arm. Perforations on the handle allow for the handle to be torn to create two loop portions for increased access to the top portion. A closure device is provided adjacent the outer gusset.

Upon opening the closure device, frangible sections of both the outer and inner gussets must be broken open to gain access to the interior of the bag.

SUMMARY OF THE INVENTION

According to one embodiment of the present invention, a reclosable pouch includes a closure assembly that comprises first and second closure profiles disposed on first and second side panels, respectively. A handle is provided that comprises discrete first and second handle sections. Each handle section has an opening in a central portion thereof. The first handle section is attached only to the first side panel at an area below the first closure profile and the second handle section is attached only to the second side panel at an area below the second closure profile.

According to another embodiment of the present invention, a reclosable pouch includes a proximal portion of a first zipper tape strip attached to a first side panel and a proximal portion of a second zipper tape strip attached to a second side panel. First and second closure profiles are disposed in an opposing relationship on distal portions of the first and second zipper tape strips, respectively. The distal portions are disposed farther from a bottom portion of the pouch than the respective proximal portions. A first handle section is provided that includes a first end attached to either the first side panel or the first zipper tape strip at a section below the first closure profile. A second handle section is also provided that includes a third end attached to either the second side panel or the second zipper tape strip at a section below the second closure profile.

According to a further embodiment of the present invention, a reclosable pouch includes a first sheet attached to an upper portion of a first side panel and a second sheet attached to an upper portion of a second side panel. The first sheet comprises a first end and a second end, wherein a first handle section is adjacent the first end and a first closure profile is adjacent the second end. The first sheet is attached to the first side panel at an area of attachment between the first closure profile and the first end. The second sheet comprises a third end and a fourth end, wherein a second handle section is adjacent the third end and a second closure profile is adjacent the fourth end. The second sheet is attached to the second side panel at an area of attachment between the second closure profile and the third end. An opening is also provided in a central portion of the first and second handle sections.

In accordance with yet another embodiment of the present invention, a reclosable pouch includes a first side panel comprising a first handle section and a second side panel comprising a second handle section, wherein the first and second handle sections have an opening in a central portion thereof. A proximal portion of a first zipper tape strip is attached to an internal surface of the first side panel and a proximal portion of a second zipper tape strip is attached to the internal surface of the second side panel. The first and second closure profiles are disposed in an opposing relationship on distal ends of the first and second zipper tape strips, respectively. The distal portions are farther from a bottom portion of the pouch than the respective proximal portions. Further, the distal portions of the respective first and second zipper tape portions are not attached to the first and second side panels, respectively.

According to another embodiment of the present invention, a reclosable pouch includes a first side panel having a first end and a second end and a second side panel having a third end and a fourth end. The first and third ends are disposed at a bottom portion of the pouch. A first zipper strip is disposed on an internal surface of the first side panel and a second zipper strip is disposed on the internal surface of the second side panel, wherein the first and second zipper strips include opposed first and second closure profiles, respectively. The pouch further includes a first fold line at a top portion of the pouch that is positioned between the first zipper strip and a second fold line on the first side panel. The second fold line is positioned between the first fold line and the second end. An area adjacent the second fold line is sealed to the outer portion of the first side panel between the first end and the first zipper strip. A handle section comprises an area between the second fold line and the second end, wherein the handle section includes an opening in a central portion thereof.

Other aspects and advantages of the present invention will become apparent upon consideration of the following detailed description and the attached drawings, in which like elements are assigned like reference numerals.

DETAILED DESCRIPTION OF THE DRAWINGS

Figure 1:
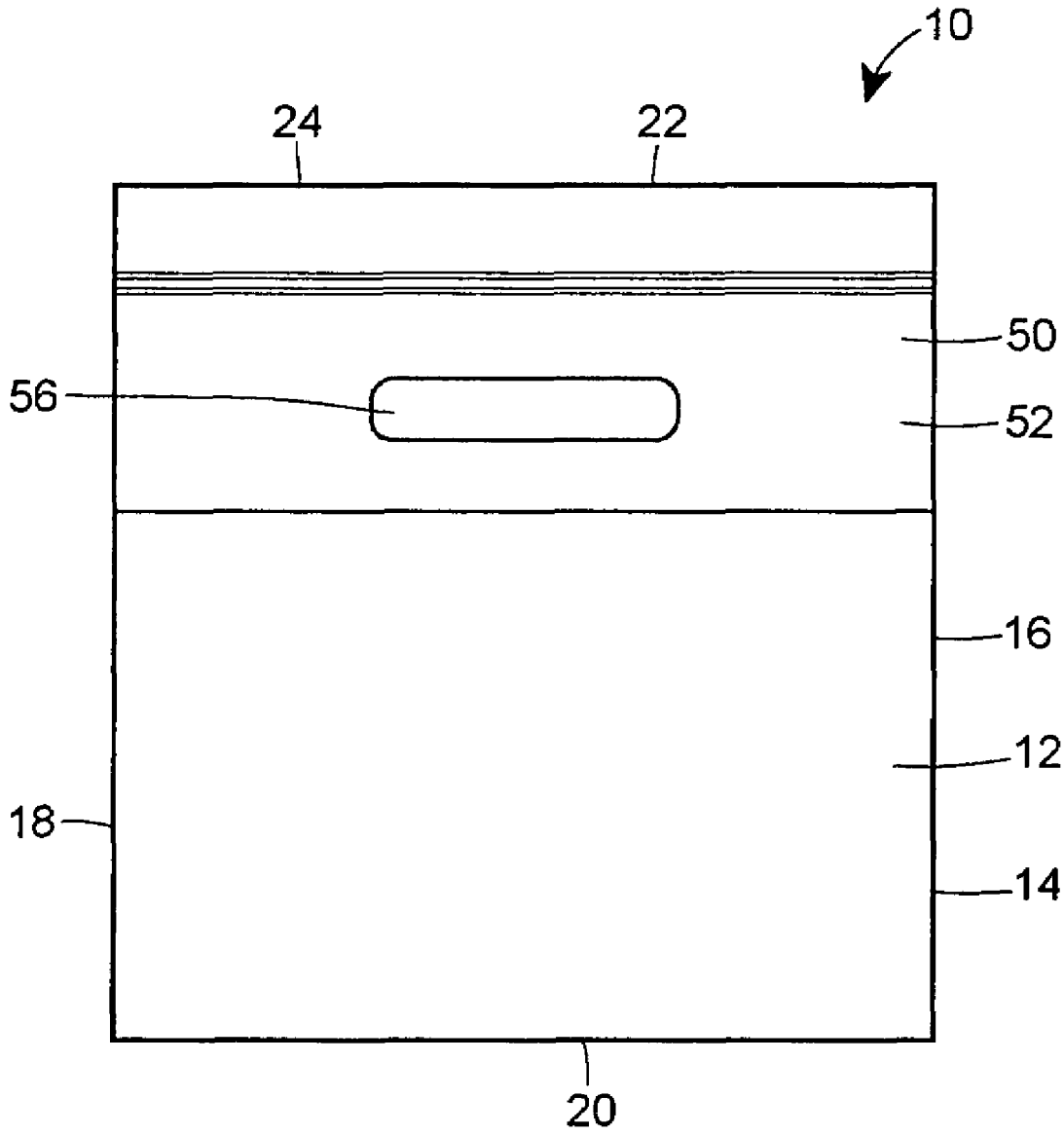
FIG. 1 is an elevational view of a reclosable thermoplastic storage pouch incorporating the present invention.
Figure 1A:
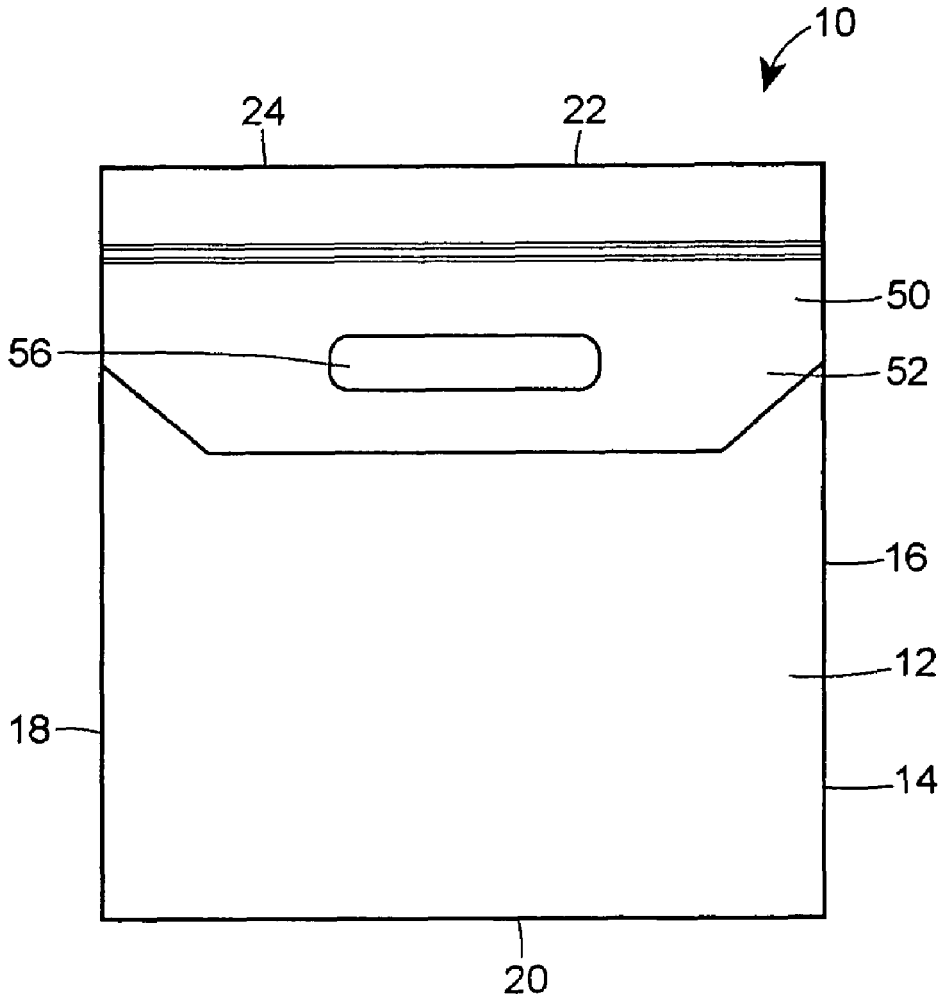
FIG. 1A is an elevational view of a pouch similar to the one shown in FIG. 1.

Referring to FIGS. 1 and 1A, a reclosable pouch 10 in the form of a thermoplastic storage bag comprises first and second side panels 12, 14. The first and second side panels 12, 14 are joined at first and second side portions 16, 18 and at a bottom portion 20. A mouth 22 is disposed at a top portion 24 of the pouch 10.

Figure 2:
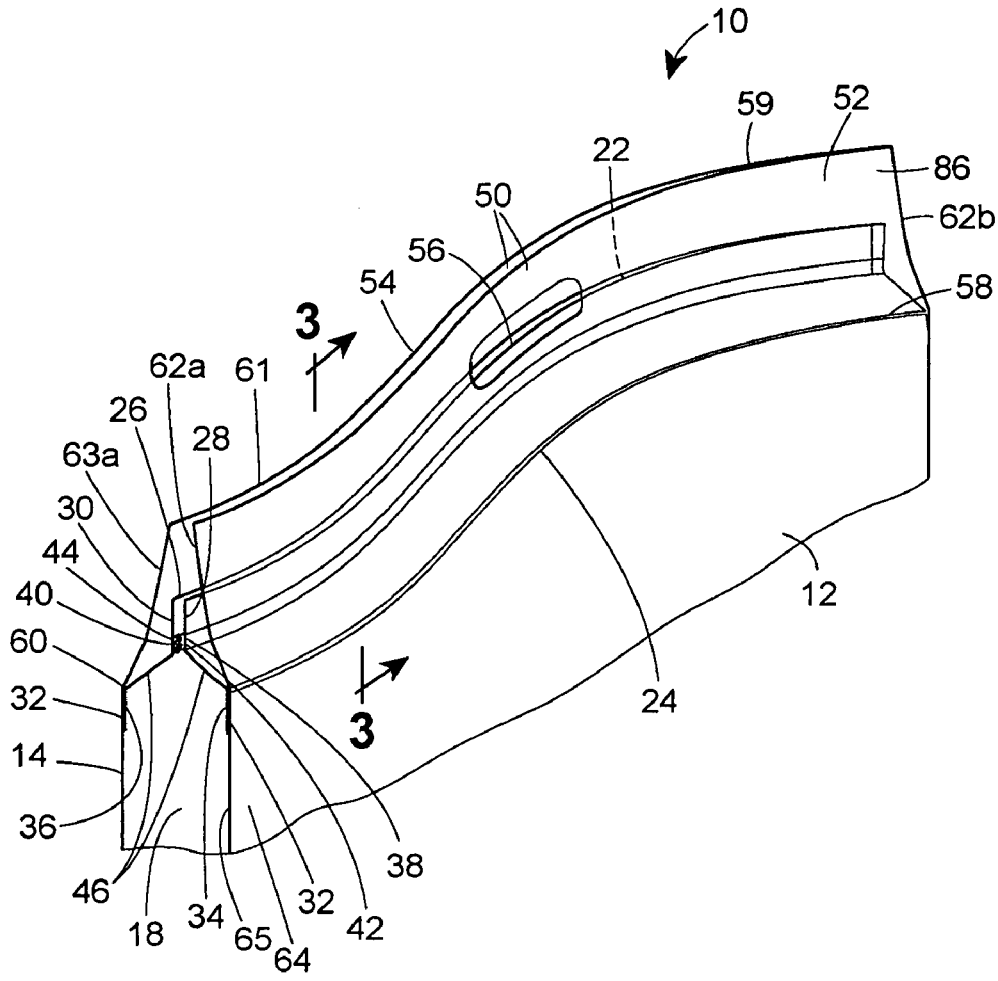
FIG. 2 is a fragmentary isometric view of an embodiment of the present invention.

In the embodiment depicted in FIG. 2 a closure assembly 26 is shown that comprises first and second zipper tape strips 28, 30, respectively. The first zipper tape strip 28 is attached to an upper portion 32 of the first side panel 12 and the second zipper tape strip 30 is attached to the upper portion 32 of the second side panel 14. The first and second zipper tape strips 28, 30 include first and second zipper tape portions 34, 36 attached to the side panels 12, 14, respectively. The first and second zipper tape strips 28, 30 also include first and second distal portions 38, 40, respectively, wherein the distal portions 38, 40 are not attached to the side panels 12, 14. The first and second distal portions 38, 40 include first and second closure profiles 42, 44, respectively, attached to inner portions thereof. The first and second closure profiles 42, 44 are oriented in an opposing relationship with each other so that engaging members (not readily seen owing to the scale of the drawings) of the respective profiles 42, 44 can mate and seal the pouch 10. In any of the embodiments disclosed herein, a slider (not shown) of the type known by those skilled in the art may be used to open and close the closure profiles. The proximal portions 34, 36 of the of the first and second zipper tape strips 28, 30 are disposed closer to an inner or product side of the pouch 10 than the distal portions 38, 40. Consequently, the distal portions 38, 40 are positioned closer to the mouth 22 of the pouch 10 than the proximal portions 34, 36.

The present embodiment also includes a handle 50 disposed on the first and second side panels 12, 14, and/or the first and second zipper tape strips 28, 30, of the pouch 10. In any of the embodiments disclosed herein, the handle 50 may be attached to the pouch 10 or zipper tape strips 28, 30 by heat sealing, ultrasonic sealing, one or more adhesives, or in any other manner known to those skilled in the art. Preferably, the handle 50 comprises separate first and second handle sections 52, 54. Each handle section 52, 54 includes an opening 56 in a central portion thereof. In a preferred embodiment the openings 56 of opposing handle sections 52, 54 are aligned with each other. The openings 56 are also preferably sized to allow a hand of a user to fit through therethrough.

In a preferred embodiment, the first handle section 52 includes a first end 58, a second end 59, and two side edges 62*a*, 62*b*. Similarly, the second handle section 54 includes a third end 60, a fourth end 61, and two side edges 63*a*, 63*b*. In any of the embodiments disclosed herein, the process of sealing the side panels 12, 14 to one another may cause the first and second handles sections to be sealed to one another. In that event, it may be desirable to cut or otherwise separate the handle sections from one another. The first and third ends 58, 60 act as a point of attachment for connecting the first and second handle sections 52, 54 to an area at or below the first and second closure profiles 42, 44. Generally, the first and third ends 58, 60 of the first and second handle sections 52, 54 may be attached to external surfaces 64 or internal surfaces 65 of the first and second side panels 12, 14, respectively. In the event that the first and second handle sections 52, 54 are secured to the internal surfaces of the first and second side panels 12, 14, the first and second zipper tape strips 28, 30 are joined to the handle sections 52, 54 and/or are joined to the side panels 12, 14 below the attachment points of the handle sections 52, 54 to the side panels 12, 14. Conversely, the first and third ends 58, 60 of the first and second handle sections 52, 54 may be attached to external surfaces 64 or internal surfaces 65 of the first and second zipper tape strips 28, 30, respectively. Those skilled in the art will realize the multitude of arrangements possible from the examples described herein.

Figure 3:
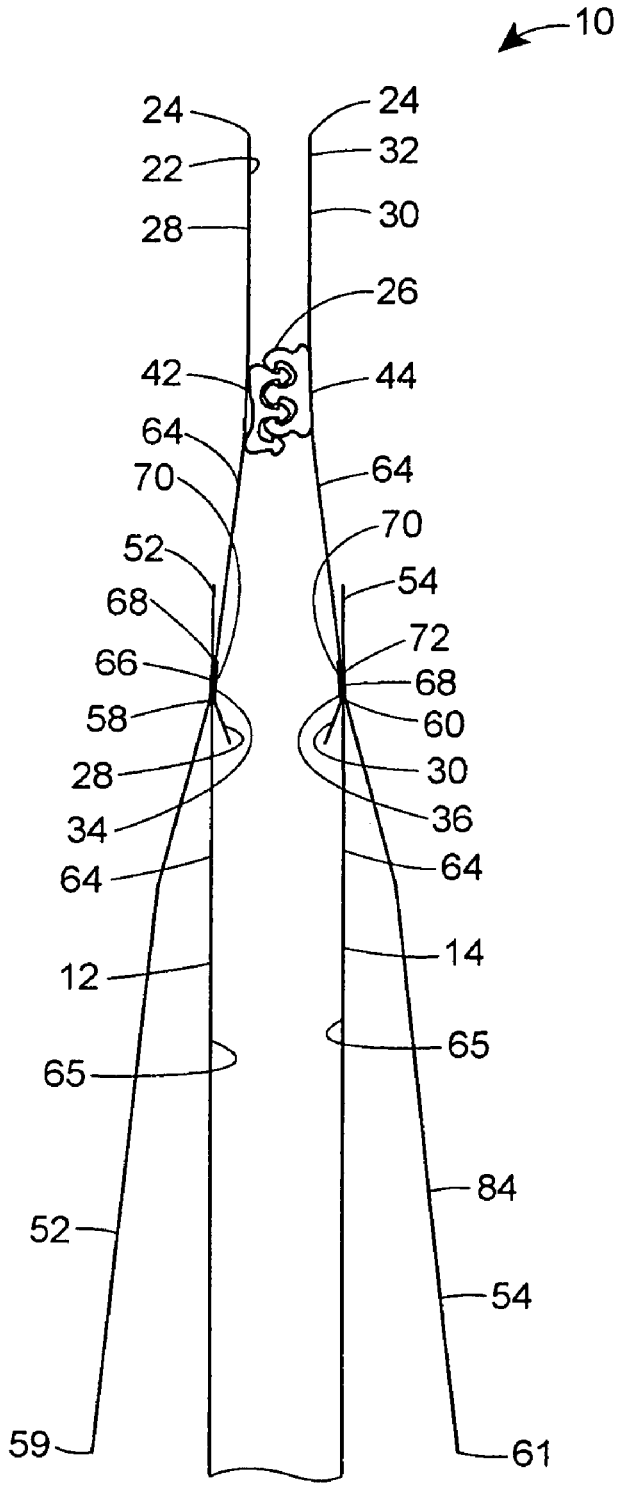
FIG. 3 is an enlarged, fragmentary, sectional view taken generally along the lines 3-3 of FIG. 2.

Referring to the embodiment shown in FIGS. 2 and 3, the first end 58 of the first handle section 52 is attached to the external surface 64 of the first side panel 12 along an attachment section 66. The section 66 comprises an area of the side panel 12 and extends from the first side portion 16 to the second side portion 18. The first end 58 of the first handle section 52 is attached to an external portion 68 of the side panel 12 and the external surface 64 of the zipper tape strip 28 is attached to an internal portion 70 of the side panel 12. Similarly, the third end 60 of the second handle section 54 is attached to the external surface 64 of the second side panel 14 along an attachment section 72. The third end 60 of the second handle section 54 is attached to the external portion 68 of the side panel 14 and the external surface 64 of the zipper tape strip 30 is attached to the internal portion 70 of the side panel 14. Preferably, the sections 66 and 72 are located closer to the top portion 24 of the pouch 10 than the bottom portion 20 of the pouch 10.

Figure 4:
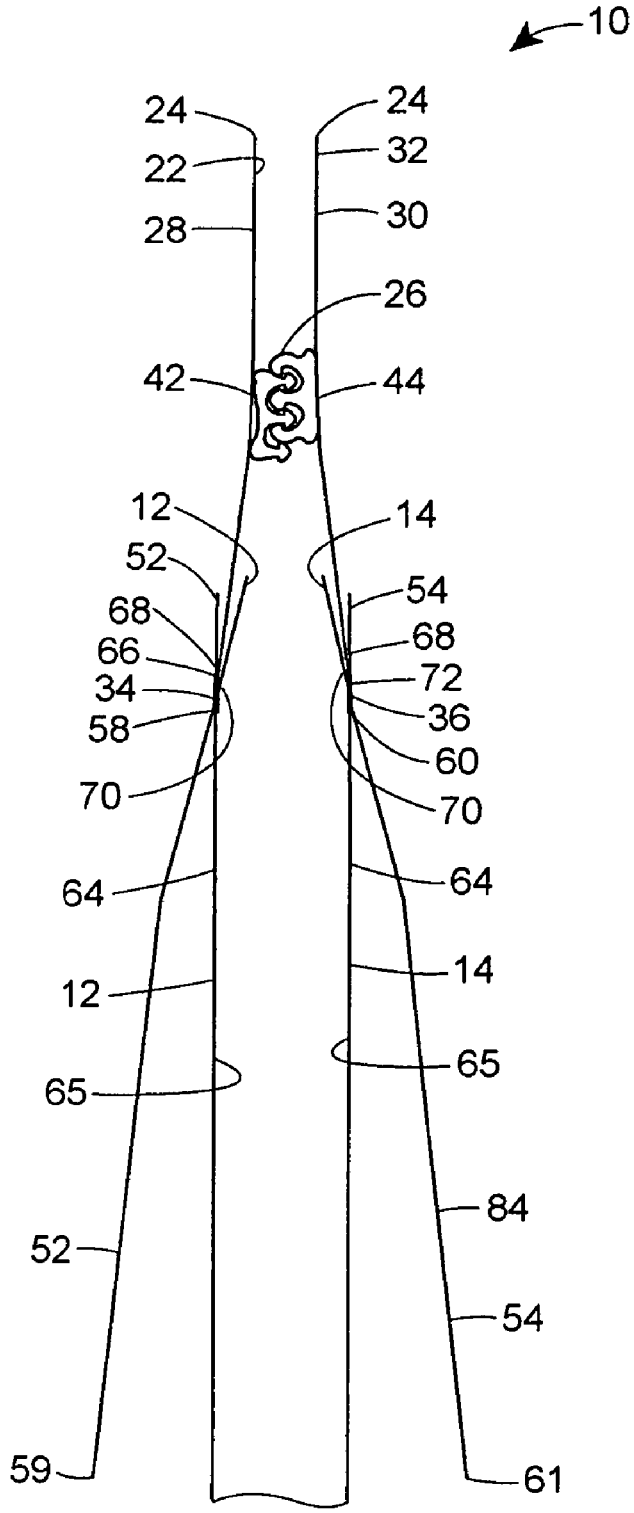
FIGS. 4-6 are views similar to FIG. 3 illustrating alternative embodiments of the present invention.

In an alternative embodiment depicted in FIG. 4, the sections 66 and 72 comprise areas of the first and second proximal portions 34, 36 instead of the side panels 12, 14. In this embodiment, the first end 58 of the first handle section 52 is attached to the external portion 68 of the section 66 and the third end 60 of the second handle section 54 is attached to the external portion 68 of section 72. Additionally, the side panel 12 is attached to the internal portion 70 of the section 66 and the side panel 14 is attached to the internal portion 70 of the section 72. The embodiments of FIGS. 3 and 4 are similar in that both include first and third ends 58, 60 of handle sections 52, 54, respectively, that are joined to opposing areas of the pouch 10, wherein the areas comprise the intersection of the handle sections 52, 54, the side panels 12, 14, and the zipper tape strips 28, 30, respectively.

Figure 5:
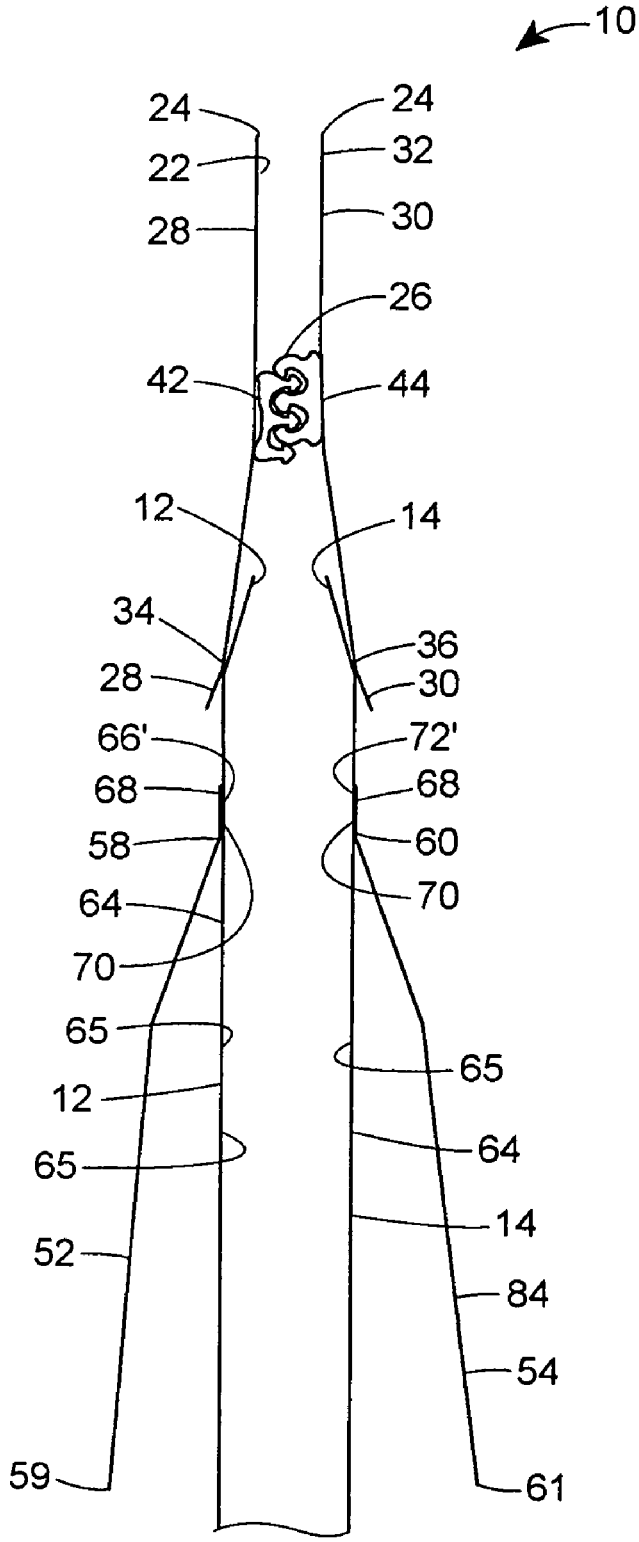

In another embodiment depicted in FIG. 5, the first and third ends 58, 60 of the handle sections 52, 54 are joined to the sections 66' and 72', respectively, as depicted in FIG. 3. The sections 66' and 72' comprise areas of the external and the internal surfaces 64, 65 of the first and second side panels 12, 14, respectively. The first end 58 of the first handle section 52 is attached to the external portion 68 of the section 66' and the third end 60 of the second handle section 54 is attached to the external portion 68 of the section 72'. The internal portions 70 of the sections 66', 72' are not joined to any structure of the pouch 10. The sections 66', 72' are also disposed below the first and second proximal portions 34, 36, respectively, wherein the proximal portions are attached to the first and second side panels 12, 14, respectively, at an area closer to the mouth 22 of the pouch 10 than the sections 66', 72'. It is preferred that a distance between the top portion 24 of the pouch 10 and the section 66' be equal to the distance between the top portion 24 of the pouch 10 and the section 72'.

Figure 6:
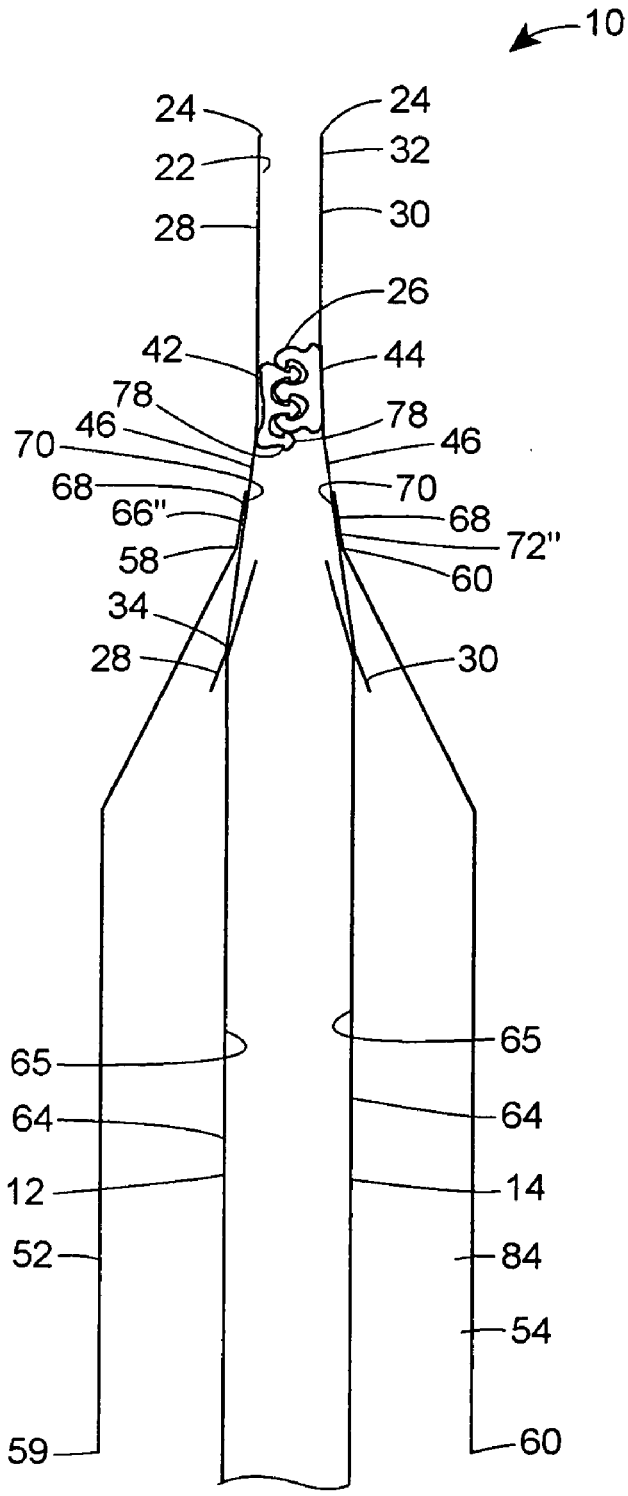

In yet another alternative embodiment depicted in FIG. 6, the first and third ends 58, 60 of the handle sections 52, 54 are joined to the sections 66" and 72", respectively, as depicted in FIG. 4. The sections 66" and 72" comprise areas of the external and internal surfaces 64, 65 of intermediate portions 46 of the first and second zipper tape strips 28, 30, respectively. The first end 58 of the first handle section 52 is attached to the external portion 68 of the section 66" and the third end 60 of the second handle section 54 is attached to the external portion 68 of the section 72". The internal portions 70 of the sections 66", 72" are not joined to any structure of the pouch 10. The sections 66", 72" are also disposed above the first and second proximal portions 34, 36, respectively, wherein the proximal portions are attached to the first and second side panels 12, 14, respectively, closer to the bottom portion 20 of the pouch 10 than the sections 66", 72". Preferably, the distance between the top portion 24 of the pouch 10 and the section 66" is equal to the distance between the top portion 24 of the pouch 10 and the section 72".

In all of the embodiments discussed above, the first and third ends 58, 60 of the first and second handle sections 52, 54 are disposed on an area of the side panels 12, 14 and/or the zipper tape strips 28, 30, respectively, below the first and second closure profiles 42, 44, respectively. In a preferred embodiment, the first and third ends 58, 60 of the handle sections 52, 54 are disposed about 1 inch (25.4 mm.) below the closure profiles 42, 44 on the side panels 12, 14 and/or the zipper tape strips 28, 30. By attaching the first and third ends 58, 60 of the handle sections 52, 54 below the closure profiles 42, 44, the first and second handle sections 52, 54 exert substantially less external opening forces on an external side (filling side) of the closure assembly 26 than conventional pouches. By reducing the external opening forces, the risk of unwanted pouch opening is decreased.

As noted above, the first and third ends 58, 60 of the handle sections 52, 54 preferably extend the full distance between the first and second side portions 16, 18. In other embodiments, the first and third ends 58, 60 extend only over a portion of this distance. In still other embodiments, the first and third ends 58, 60 include a discrete section attached to the side panels 12, 14 or the zipper tape strips 28, 30, wherein intermediate sections located between the attached sections are not joined to the side panels 12, 14. It is also preferred that the second and fourth ends 59, 61 are substantially coextensive with the first and third ends 58, 60, respectively, so that the handle sections 52, 54 have a rectangular shape, such as the embodiment shown in FIG. 1. In other embodiments, the handle sections 52, 54 have different shapes than one another or are of the same shape. These shapes, such as the one shown in FIG. 1A, may include triangular, semicircular, trapezoidal or irregular configurations. While the handle sections 52, 54 may have any equal or unequal heights, it is preferred that the height of each of the handle sections 52, 54 be within a range of about 3.0 in. (76.2 mm.) to about 6 in. (152.4 mm.), and it is most preferred that both the handles have a height of about 4.5 in. (114.3 mm.).

The handle 50 of the present invention is capable of folding about the first and third ends 58, 60. Specifically, the first and third ends 58, 60 act as hinges to allow either of the handle sections 52, 54 to independently traverse a range of potential handle section positions between a rest position 84 and an in-use position 86. When the handle sections 52, 54 are in the rest position 84, the handle sections 52, 54 are disposed flat against the respective side panels 12, 14 of the pouch 10. When the handle sections 52, 54 are in the in-use position 86, the handle sections 52, 54 are rotated a sufficient number of degrees from the rest position to allow the user to place his hands through the openings 56 of both the handle sections 52, 54. While it is preferred that the first and third ends 58, 60 be used as the line of rotation for the handle sections 52, 54, any section of the handle sections 52, 54 may be bent or folded if desired by a user.

The handle 50 of any of the embodiments herein is preferably formed from similar thermoplastic material as used to make the side panels 12, 14 of the pouch 10. One of the materials used to make the film for the pouches 10 is a monolayer or multilayer polyethylene, such as a low density polyethylene, a linear low density polyethylene, and/or ethylene vinyl acetate, and/or a co-polymer, mixture, multilayer combination, or laminate(s) thereof. While the handle 50 may be substantially the same thickness as the side panels 12, 14, other embodiments utilize handles 50 that are thinner or thicker than the side panels 12, 14. The thickness of the handle 50 may be selected according to a variety of requirements, such as the average stress placed on the handle 50, the economic feasibility of producing multiple thermoplastic layers of varying thickness, and certain tactile considerations. Indeed, the thicknesses of handle sections comprising the handle 50 may be the same or different from one another and/or the sections may have thicknesses that vary within each of the sections. If it is desired to make the handle 50 stronger, the handle could be formed by using any of the aforementioned materials and co-extruding same with a high density polyethylene or by laminating a strong plastic, such as polyethalene teraphalate or an oriented polypropylene thereto. Other materials that could be used to manufacture the pouch 10 and/or handle 50 include polypropylene, any other thermoplastic material, or any other material known to those skilled in the art that offers significant advantages not found in thermoplastic materials. In any of the foregoing embodiments, either of the handle sections may comprise a different material or structure than a material or structure of one or both of the first and second side panels 12, 14.

Figure 7:
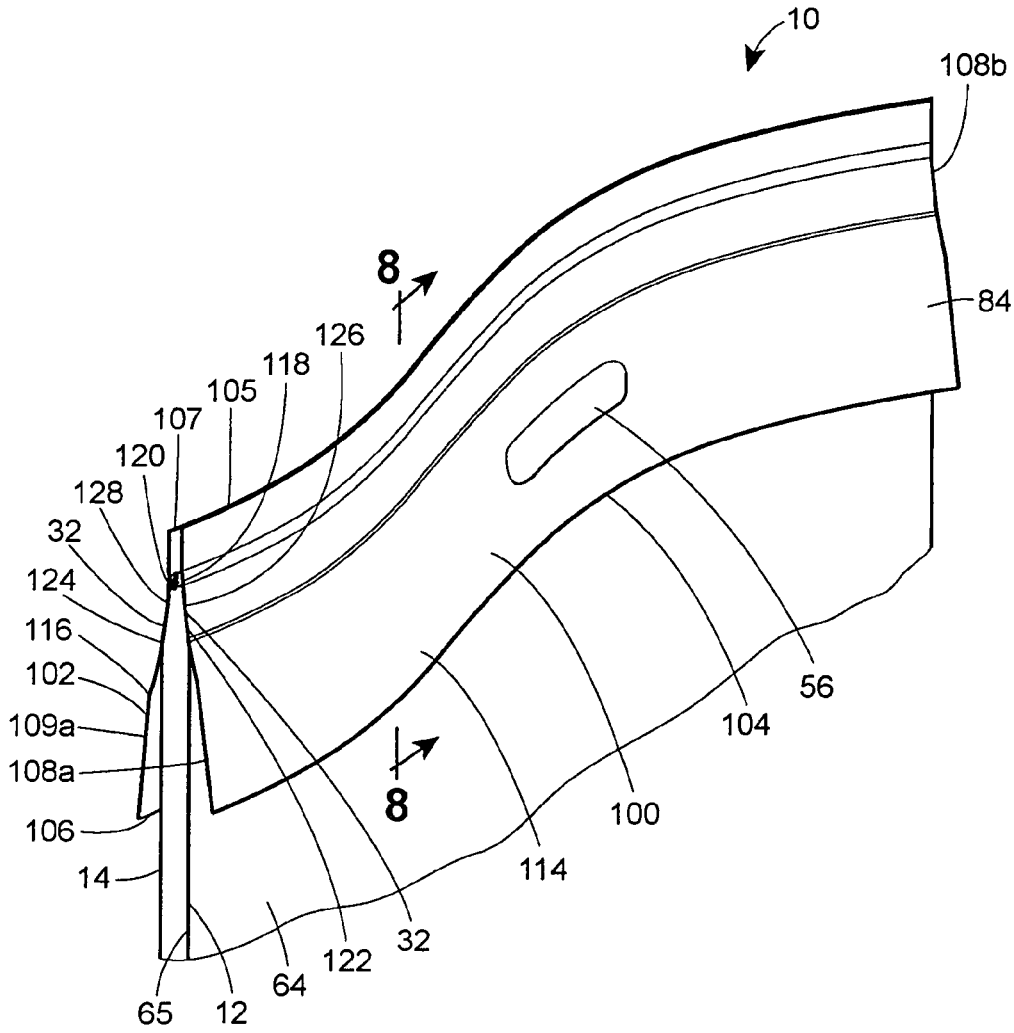
FIG. 7 is a fragmentary isometric view illustrating another alternative embodiment of the present invention.
Figure 8:
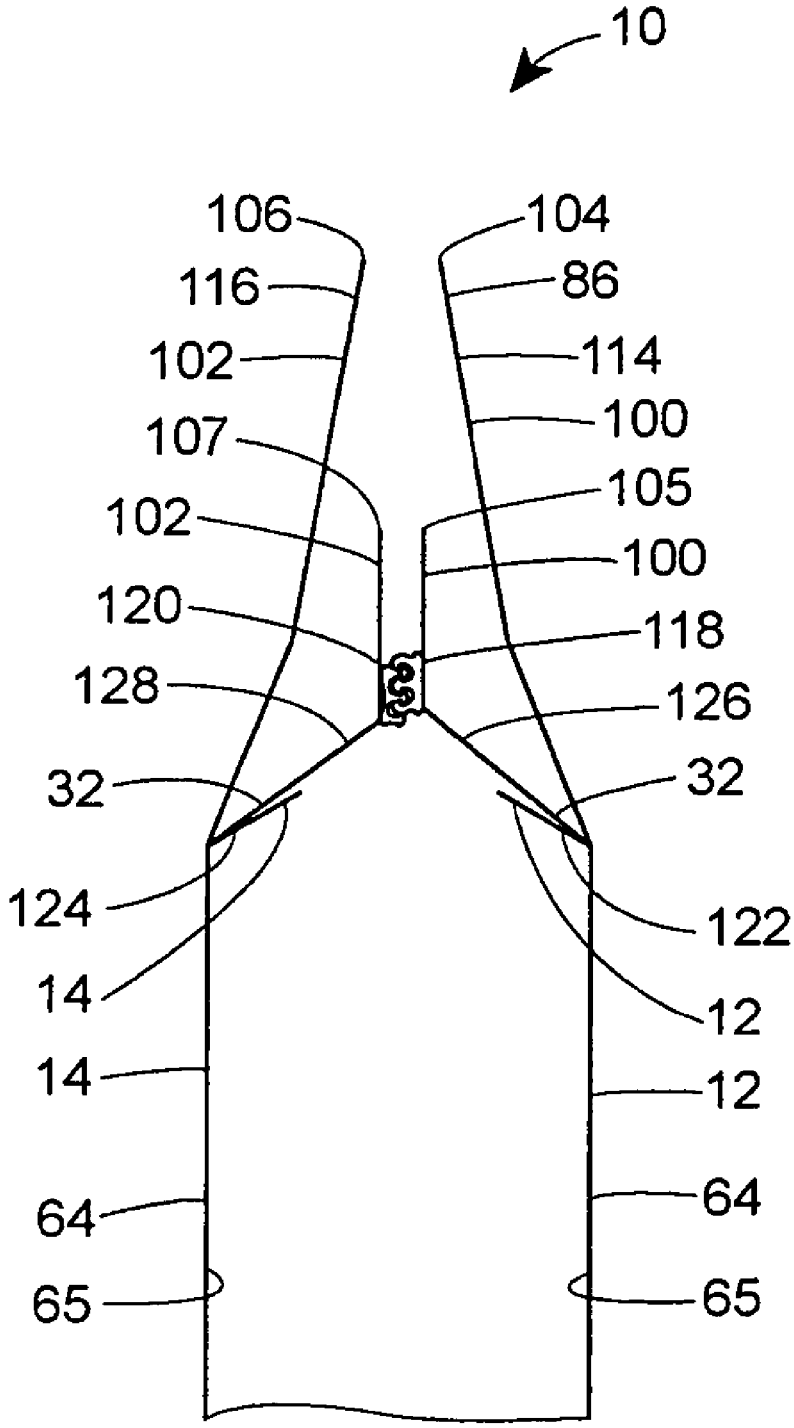
FIG. 8 is an enlarged, fragmentary, sectional view taken generally along the lines 8-8 of FIG. 7.

FIGS. 7 and 8 show another embodiment of the present invention that utilizes a first sheet 100 and a second sheet 102. Preferably, the first sheet 100 includes a first end 104, a second end 105, and two sides 108*a*, 108*b*. Similarly, the second sheet 102 includes a third end 106, a fourth end 107, and two sides 109*a*, 109*b*. The first and third ends 104, 106 of the first and second sheets 100, 102 also include first and second handle sections 114, 116, respectively. The first and second handle sections 114, 116 include the opening 56 in a central portion thereof. Further, both the first and second sheets 100, 102 include first and second closure profiles 118, 120, respectively, disposed adjacent the respective second and fourth ends 105, 107.

The first and second sheets 100, 102 are affixed to areas of attachment 122, 124. The areas of attachment 122, 124 comprise an area of the first and second side panels 12, 14, respectively, that extend from the first side portion 16 to the second side portion 18. The areas of attachment 122, 124 are also preferably located adjacent the upper portions 32 of the respective first and second side panels 12, 14. As in the preceding embodiments, the first and second sheets 100, 102 are affixed to the areas of attachment 122, 124 that extend substantially fully across a width of the first and second sheets 100, 102, wherein the width of either sheet 100, 102 is the distance between the two sides 108*a*, 108*b* and 109*a*, 109*b*, respectively.

The embodiment shown in FIGS. 7 and 8 also includes first and second intermediate portions 126, 128 that comprise an area of the first and second sheets 100, 102, respectively. The first intermediate portion 126 lies between the area of attachment 122 and the first closure profile 118, while the second intermediate portion 128 lies between the area of attachment 124 and the second closure profile 120. The first and second closure profiles 118, 120 and the first and second intermediate portions 126, 128 are farther from the bottom portion 20 of the pouch 10 than the areas of attachment 122, 124. The first handle section 114 is bounded by the area of attachment 122 and the first end 104 of the first sheet 100, and the second handle section 116 is bounded by the area of attachment 124 and the third end 106 of the second sheet 102. By constructing the pouch 10 in such a manner, opening forces directed toward the internal side of the closure profiles 118, 120 due to lifting of the pouch 10 by the handle sections 114, 116 are greater than opening forces exerted on the external side of the closure profiles 118, 120 during such lifting. By suitably designing the profiles in each of the foregoing embodiments, this differential force application can be compensated for so that unintentional bag opening is prevented during lifting by the handles.

The handle sections 114, 116 may be folded along any portion thereof between the areas of attachment 122, 124 and the respective first and third ends 104, 106. However, it is preferred that the handle sections 114, 116 fold along the areas of attachment 122, 124, respectively. Therefore, when the handle 50 is being used, the first and second handle sections 114, 116 are rotated about the areas of attachment, 122, 124, respectively, toward the in-use position 86.

Figure 9:
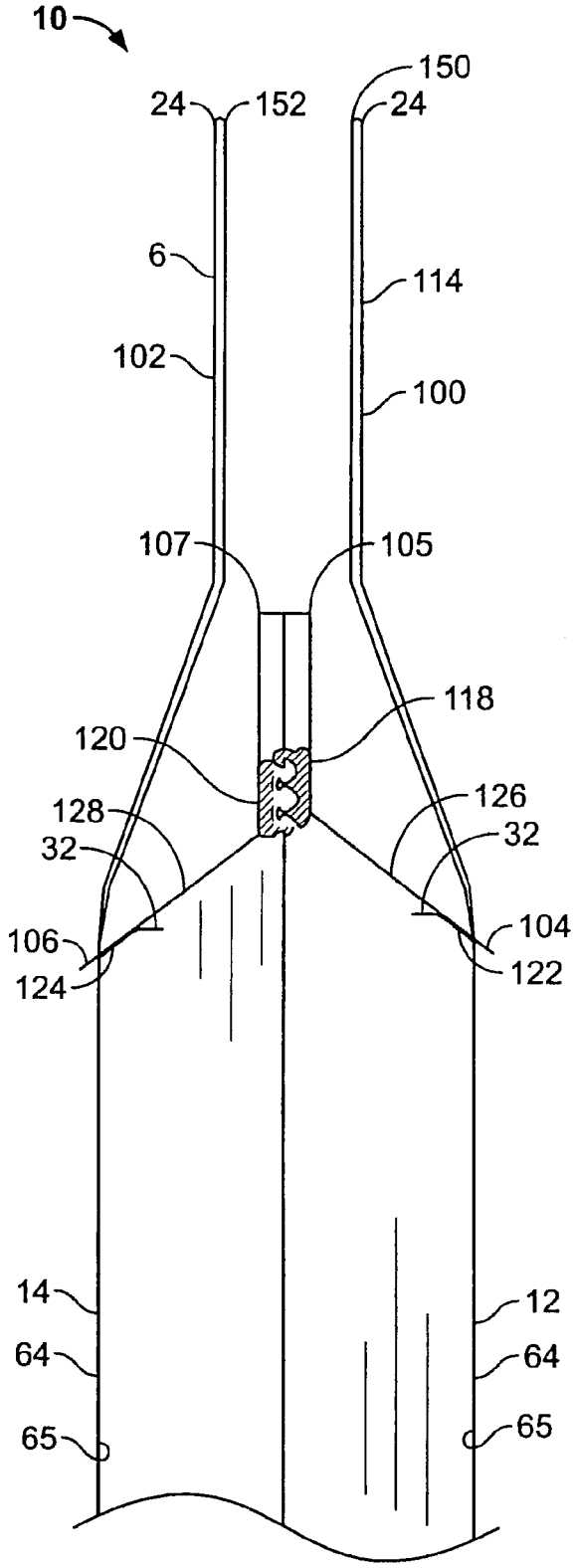
FIG. 9 is a fragmentary sectional view similar to FIG. 8 of a further embodiment of the present invention.

Referring next to FIG. 9, which illustrates an embodiment similar to the embodiment of FIGS. 7 and 8, the first and second sheets 100, 102 include first and second fold lines 150, 152, respectively. The fold lines 150, 152 are disposed at the top portion 24 of the pouch 10. The first fold line 150 is formed in the first sheet 100 between the first end 104 and the first closure profile 118. The second fold line 152 is formed in the second sheet 102 between the third end 106 and the second closure profile 120. The first and third ends 104, 106 of the first and second sheets 100, 102 are attached to the first and second sheets 100, 102 below (i.e., closer to the bottom portion 20 than) the first and second fold lines 150, 152, respectively. The first and third ends 104, 106 may be attached to either an external surface 64 or an internal surface 65 of the respective first or second sheets 100, 102. Therefore, the sheets 100, 102 are attached to themselves to form loop-shaped first and second handle sections 114, 116, respectively. The first and second handle sections 114, 116 include the opening 56 in a central portion thereof. Preferably, the first end 104 of the first sheet 100 is attached to itself adjacent the area of attachment 122 and the third end 106 of the second sheet 102 is attached to itself adjacent the area of attachment 124. By attaching the first and third ends 104, 106 adjacent the areas of attachment 122, 124, the first handle section 114 is bounded by the first fold line 150 and the area of attachment 122 and the second handle section 116 is bounded by the second fold line 152 and the area of attachment 124. In another embodiment, the first and third ends 104, 106 of the sheets 100, 102 are attached to the respective sheets 100, 102 above the areas of attachment 122, 124. In yet another embodiment, the first and third ends 104, 106 of the sheets 100, 102 are attached to the respective sheets 100, 102 below the areas of attachment 122, 124. In all other aspects, the present embodiments may incorporate similar structure and function as discussed in conjunction with the embodiments of FIGS. 7 and 8.

Figure 10:
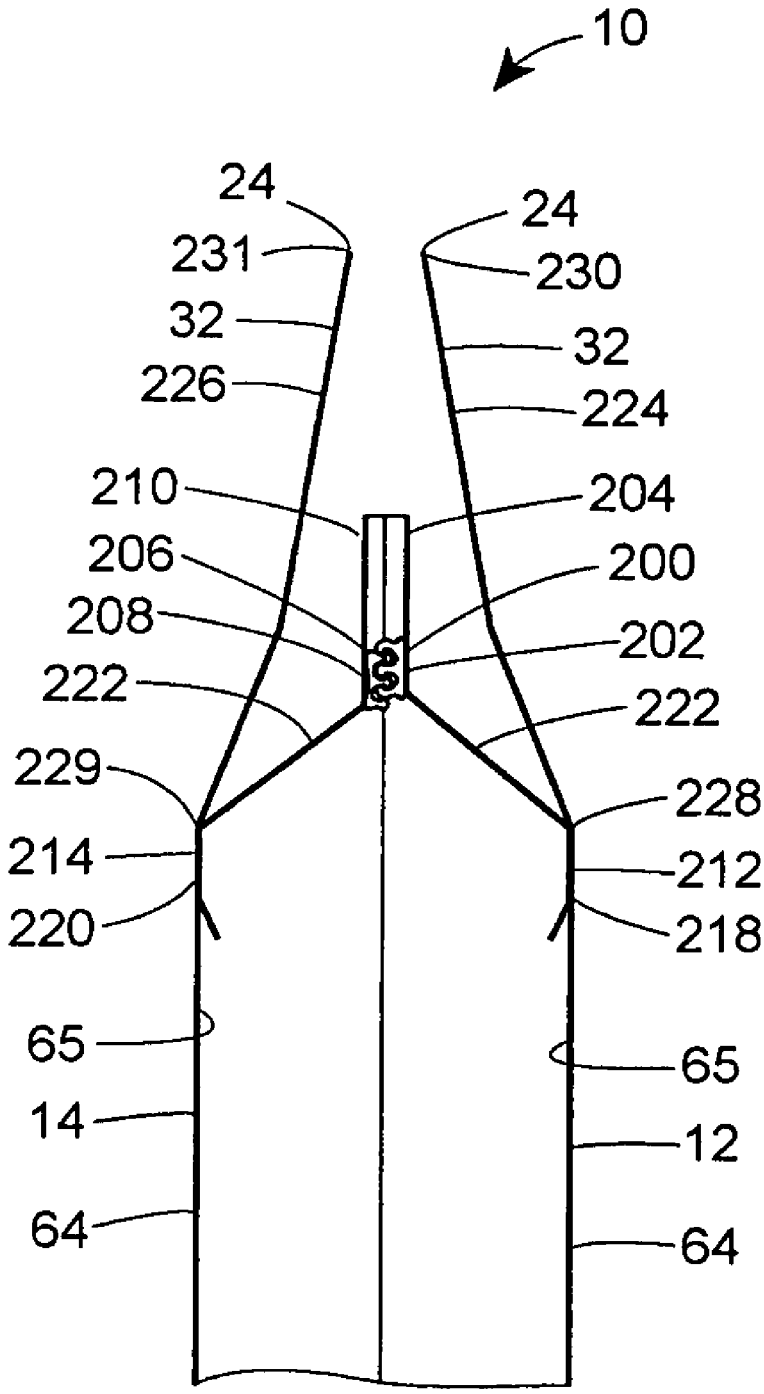
FIG. 10 is a fragmentary sectional view of another embodiment of the present invention.

FIG. 10. shows yet another alternative embodiment of the present invention, wherein a first closure profile 200 is attached to a first distal portion 202 of a first zipper tape strip 204, and a second closure profile 206 is attached to a second distal portion 208 of a second zipper tape strip 210. The first and second zipper tape strips 204, 210 also include first and second proximal portions 212, 214, respectively. The first proximal portion 212 is attached to the internal surface 65 of the first side panel 12 along an attachment section 218. The attachment section 218 comprises an area of the side panel 12 and extends substantially from the first side portion 16 to the second side portion 18. Similarly, the second proximal portion 214 of the second zipper tape strip 210 is attached to the internal surface 65 of the second side panel 14 along an attachment section 220. Preferably, intermediate portions 222 extend upwardly between the proximal portions 212, 214 and the distal portions 202, 208, respectively. The intermediate portions 222 and the closure profiles 200, 206 are thus positioned farther from the bottom portion 20 of the pouch 10 than the proximal portions 212, 214. It is also preferred that a distance between the top portion 24 of the pouch 10 and the section 218 be equal to the distance between the top portion 24 of the pouch 10 and the section 220.

The embodiment of FIG. 10 also includes the openings 56 adjacent upper portions 32 of the first and second side panels 12, 14. Therefore, as should be evident from an inspection of FIG. 10, first and second handle sections 224, 226 are integrally formed with the first and second side panels 12, 14, respectively. The first and second attachment sections 218, 220 define first and second ends 228, 229 of the first and second handle sections 224, 226, respectively. The first handle section 224 is bounded by the first end 228 and a third end 230, and the second handle section 226 is bounded by the second end 229 and a fourth end 231. The first handle section 224 may be folded along any portion thereof between the first end 228 and the third end 230, and the second handle section 226 may be folded along any portion thereof between the second end 229 and the fourth end 231. However, it is preferred that the handle sections 224, 226 fold at lines adjacent the respective first and second ends 228, 229. When the handle 50 is used, forces exerted on the internal side are greater than forces exerted on the external side because the closure profiles 200, 206 are disposed above the attachment sections 218, 220, as discussed above in connection with the other embodiments.

Figure 11:
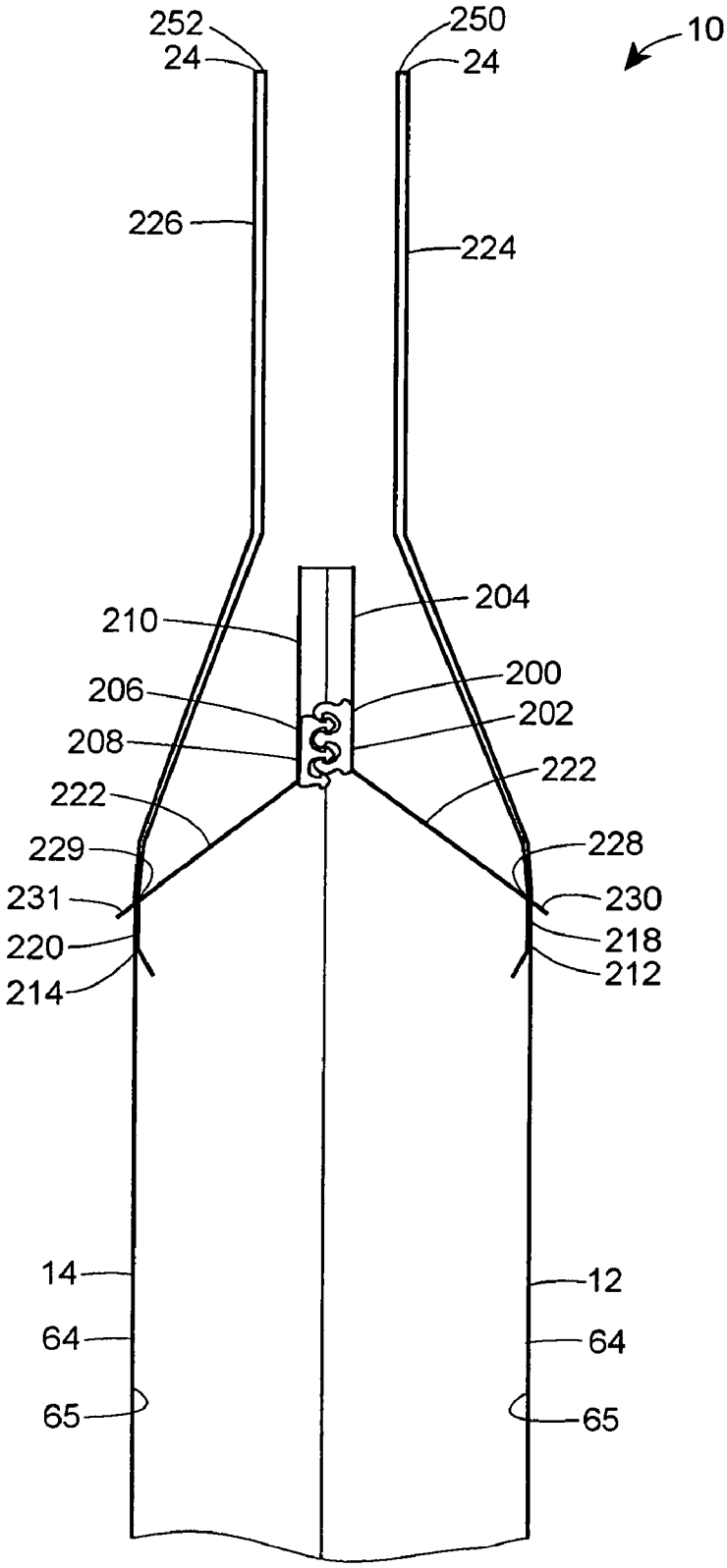
FIG. 11 is a view similar to FIG. 10 illustrating an alternative embodiment of the present invention.

In an embodiment similar to the embodiment depicted in FIG. 10, the first and second side panels 12, 14 include a first and second fold line 250, 252. FIG. 11 shows that the fold lines 250, 252 are disposed at the top portion 24 of the pouch 10. The first fold line 250 is formed in the first side panel 12 between the first and third ends 228, 230, and the second fold line 252 is formed in the second side panel 14 between the second and fourth ends 229, 231. The third and fourth ends 230, 231 of the first and second side panels 12, 14 are attached to the first and second side panels 12, 14 below the first and second fold lines 250, 252, respectively. The third and fourth ends 230, 231 may be attached to either an external surface 64 or an internal surface 65 of the respective first or second side panels 12, 14. Therefore, the side panels 12, 14 are attached to themselves to form loop-shaped first and second handle sections 224, 226, respectively. The first and second handle sections 224, 226 include the opening 56 in a central portion thereof. Preferably, the third end 230 of the first side panel 12 is attached to itself adjacent the first attachment section 218 and the fourth end 231 of the second side panel 14 is attached to itself adjacent the second attachment section 220. By attaching the third and fourth ends 230, 231 adjacent the attachment sections 218, 220, the first handle section 224 is bounded by the first fold line 250 and the first attachment section 218 and the second handle section 226 is bounded by the first fold line 252 and the second attachment section 220. In another embodiment, the third and fourth ends 230, 231 of the side panels 12, 14 are attached to the respective side panels 12, 14 above the attachment sections 218, 220. In yet another embodiment, the third and fourth ends 230, 231 of the side panels 12, 14 are attached to the respective side panels 12, 14 below the attachment sections 218, 220. In all other aspects, the present embodiments may incorporate similar structure and function as discussed in conjunction with the embodiments of FIG. 10.

Figure 12:
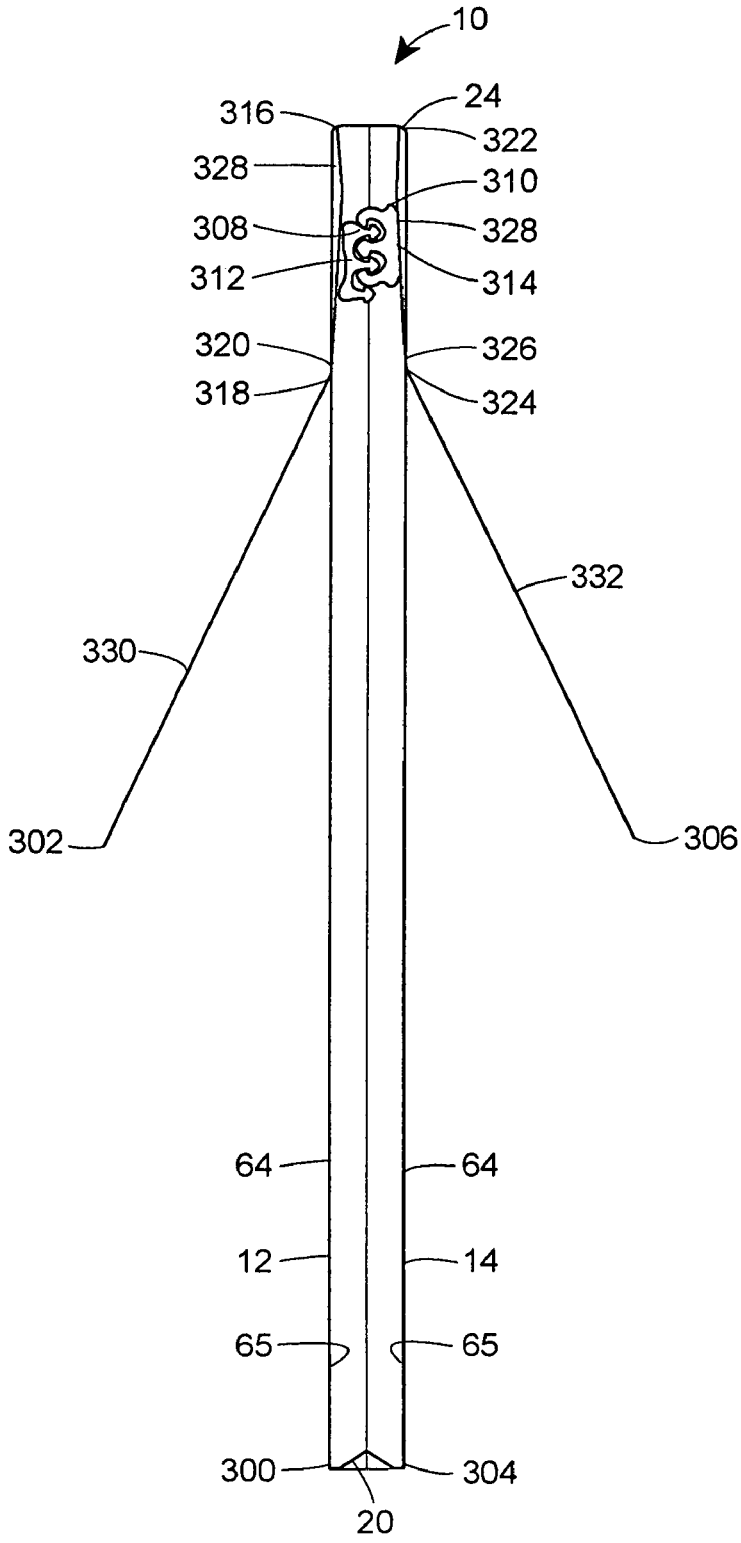
FIG. 12 is a sectional view of yet another embodiment of the present invention.

FIG. 12 depicts a further embodiment of the present invention, wherein the first side panel 12 has a first end 300 and a second end 302 and the second side panel 14 has a third end 304 and a fourth end 306. The first and third ends 300, 304 of the respective first and second side panels 12, 14 are adjacent the bottom portion 20 of the pouch 10. The bottom portion 20 in this embodiment is gusseted, however, it is intended that any of the embodiments herein may use gusseted or non-gusseted bottom portions. A first zipper strip 308 is attached to the internal surface 65 of the first side panel 12 and a second zipper strip 310 is attached to the internal surface 65 of the second side panel 14. The first zipper strip 308 includes a first closure profile 312 disposed in an opposing relationship with a second closure profile 314 of the second zipper strip 310. A first fold line 316, formed by folding the outer portion 64 of the first side panel 12 onto itself and toward the bottom portion 20 of the pouch 10, is positioned between the first zipper strip 308 and a second fold line 318 on the first side panel 12 and is also disposed at or adjacent to the top portion 24 of the pouch 10. The second fold line 318 is positioned between the first fold line 316 and the second end 302 of the first side panel 12. An area adjacent the second fold line 318 is sealed to the outer portion 64 of the first side panel 12 along a seal line 320 disposed between the first zipper tape strip 308 and the first end 300. Similarly, a third fold line 322, formed by folding the outer portion 64 of the second side panel 14 onto itself and toward the bottom portion 20 of the pouch 10, is positioned between the second zipper strip 310 and a fourth fold line 324 on the second side panel 14 and is also disposed at or adjacent to the top portion 24 of the pouch 10. The fourth fold line 324 is positioned between the third fold line 322 and the fourth end 306 of the second side panel 14. An area adjacent the second fold line 324 is sealed to the outer portion 64 of the second side panel 14 along a seal line 326 disposed between the second zipper strip 310 and the third end 304. Typically, the folded portion of the first side panel 12 is not joined to itself between the first and second fold lines 316, 318, nor is the folded portion of the second side panel 14 joined to itself between the third and fourth fold lines 322, 324. As a result of these non-joined portions of the first and second side panels 12, 14, a gap 328 may form between same.

The embodiment of FIG. 12 also includes a first handle section 330 disposed between the second fold line 318 and the second end 302 of the first side panel 12. A second handle section 332 is provided on the second side panel 14 between the fourth fold line 324 and the fourth end 306. The openings 56 are disposed in central portions of the first and second handle sections 330, 332. The handle section 330 may be folded along any portion thereof between the second fold line 318 and the second end 302 of the first side panel 12 and the handle section 332 may be folded along any portion thereof between the fourth fold line 324 and the fourth end 306 of the second side panel 14. However, it is preferred that the handle sections 330, 332 fold along the fold lines 318, 324, respectively. When the handle 50 is used, forces exerted on the internal side are greater than forces exerted on the external side because the closure profiles 312, 314 are disposed above the seal lines 320, 326, as discussed above in connection with the other embodiments.

INDUSTRIAL APPLICABILITY

The pouch described herein advantageously provides for handle sections to be disposed on external surfaces of side panels or zipper tape strips. The handle sections are further preferably disposed below closure profiles, wherein the closure profiles are positioned adjacent the mouth of the pouch. By providing handle sections in such a manner, external opening forces exerted on the closure profiles that cause unwanted opening of the pouch are significantly reduced.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A reclosable pouch, comprising:

a first sheet attached to an upper portion of a first side panel and a second sheet attached to an upper portion of a second side panel;

wherein the first sheet comprises a first end and a second end, wherein a first handle section is adjacent the first end and a first closure profile is adjacent the second end, and wherein the first sheet is attached to the first side panel at an area of attachment between the first closure profile and the first end;

wherein the second sheet comprises a third end and a fourth end, wherein a second handle section is adjacent the third end and a second closure profile is adjacent the fourth end, and wherein the second sheet is attached to the second side panel at an area of attachment between the second closure profile and the third end; and an opening in a central portion of the first and second handle sections;

wherein the first sheet includes a first fold line at a top portion of the pouch and the first end of the first sheet is attached to the first side panel below the first fold line.

2. The pouch of claim 1, wherein the first handle section extends substantially the entire length of the first side panel.

3. The pouch of claim 1, wherein the first and second handle sections exert substantially more force on an internal side of the first and second closure profiles, respectively, than on an external side of the closure profiles.

4. The pouch of claim 1, wherein the first handle section is bounded by the area of attachment and the first end of the first sheet.

5. The pouch of claim 1, wherein the first handle section folds about the area of attachment, and wherein the first handle section is capable of folding toward a bottom portion and a top portion of the pouch.

6. The pouch of claim 1, wherein the first handle section is capable of folding about any area between the area of attachment of the first handle section and the first end of the first handle section.

7. The pouch of claim 1, wherein the first end is attached to an external surface of the first sheet.

8. The pouch of claim 1, wherein the first end is attached to the first sheet adjacent the area of attachment.

9. The pouch of claim 1, wherein the first handle section is bounded by the first fold line and the first end.

10. The pouch of claim 1, wherein the first handle section has a thickness substantially equal to a thickness of one of the first and second side panels.

11. The pouch of claim 1, wherein the first handle section has a thickness less than a thickness of one of the first and second side panels.

12. The pouch of claim 1, wherein the first handle section has a thickness greater than a thickness of one of the first and second side panels.

13. The pouch of claim 1, wherein the first handle section comprises a different material than a material used to manufacture one of the first and second side panels.

14. A reclosable pouch, comprising:

a first side panel integral with a first handle section and a second side panel integral with a second handle section, wherein the first and second handle sections have art opening in a central portion thereof; and a proximal portion of a first zipper tape strip attached to an internal surface of the first side panel and a proximal portion of a second zipper tape strip attached to the internal surface of the second side panel, wherein first and second closure profiles are disposed in an opposing relationship on distal ends of the first and second zipper tape strips, respectively, the distal portions being farther from a bottom portion of the pouch than the respective proximal portions, and wherein the distal portions of the respective first and second zipper tape portions are not attached to the first and second side panels, respectively;

wherein the first side panel has a first fold line at a top portion of the pouch and a third end of the first side panel is attached to the first side panel below the first fold line.

15. The pouch of claim 14, wherein the first handle section extends substantially the entire length of the first side panel.

16. The pouch of claim 14, wherein the first and second handle sections exert substantially more force on an internal side of the first and second closure profiles, respectively, than on an external side of the closure profiles.

17. The pouch of claim 14, wherein the first handle section folds about a first end thereof, and wherein the first handle section is capable of folding toward the bottom portion and a top portion of the pouch.

18. The pouch of claim 14, wherein the first handle section is capable of folding about any area between a first end of the handle section and a third end of the handle section.

19. The pouch of claim 14, wherein the third end is attached to an external surface of the first side panel.

20. The pouch of claim 14, wherein the third end is attached to the first side panel adjacent the proximal portion of the first zipper tape strip.

21. The pouch of claim 14, wherein the first handle section is bounded by the first fold line and the third end.

22. The pouch of claim 14, wherein the first handle section has a thickness substantially equal to a thickness of one of the first and second side panels.

23. The pouch of claim 14, wherein the first handle section has a thickness less than a thickness of one of the first and second side panels.

24. The pouch of claim 14, wherein the first handle section has a thickness greater than a thickness of one of the first and second side panels.

25. A reclosable pouch, comprising:

a first side panel having a first end and a second end and a second side panel having a third end and a fourth end, wherein the first and third ends are disposed at a bottom portion of the pouch;

a first zipper strip disposed on an internal surface of the first side panel and a second zipper strip disposed on the internal surface of the second side panel, wherein the first and second zipper strips include opposed first and second closure profiles, respectively;

a first fold line at a top portion of the pouch and positioned between the first zipper strip and the second end, a second fold line positioned between the first fold line and the first end, wherein an area adjacent the second fold line is sealed to an outer portion of the first side panel between the first end and the first zipper strip; and a handle section comprising an area between the second fold line and the second end, wherein the handle section includes an opening in a central portion thereof.

26. The pouch of claim 25, further including a third fold line at the top portion of the pouch and positioned between the second zipper strip and a fourth fold line on the second side panel, wherein the fourth fold line is positioned between the third fold line and the fourth end, and wherein an area adjacent the fourth fold line is sealed to the outer portion of the second side panel between the third end and the second zipper strip.

27. The pouch of claim 26, wherein a further handle section comprises an area between the fourth fold line and the fourth end, and wherein the further handle section includes an opening in a central portion thereof.

28. The pouch of claim 27, wherein the handle section and the further handle section exert substantially more force on an internal side of the first and second closure profiles, respectively, than on an external side of the closure profiles.

29. The pouch of claim 25, wherein the handle section extends substantially the entire length of the first side panel.

30. The pouch of claim 25, wherein the handle section folds about the second fold line, and wherein the handle section is capable of folding toward the bottom portion and the top portion of the pouch.

31. The pouch of claim 25, wherein the handle section is capable of folding about any area between the second fold line and the second end of the first side panel.

32. The pouch of claim 25, wherein the handle section has a thickness substantially equal to a thickness of one of the first and second side panels.

33. The pouch of claim 25, wherein the handle section has a thickness less than a thickness of one of the first and second side panels.

34. The pouch of claim 25, wherein the handle section has a thickness greater than a thickness of one of the first and second side panels.

* * * * *

UNITED STATES PATENT AND TRADEMARK OFFICE

CERTIFICATE OF CORRECTION

PATENT NO. : 7,419,300 B2
APPLICATION NO. : 10/869099
DATED : September 2, 2008
INVENTOR(S) : James C. Pawloski, Robert R. Turvey and Bryan L. Ackerman It is certified that error appears in the above-identified patent and that said Letters Patent is hereby corrected as shown below:

Column 11, Line 46: replace “art” with --an--

Signed and Sealed this

Thirtieth Day of December, 2008

JON W. DUDAS
*Director of the United States Patent and Trademark Office*